United States Patent [19]

Keglewitsch et al.

[11] Patent Number: 4,547,036

[45] Date of Patent: Oct. 15, 1985

[54] FUSE CLIP UNIT

[75] Inventors: Josef Keglewitsch; Theodore J. Stechschulte, both of Bowling Green, Ohio

[73] Assignee: Marathon Electric Manufacturing Corp., Wausau, Wis.

[21] Appl. No.: 417,588

[22] Filed: Sep. 13, 1982

[51] Int. Cl.[4] ..... H01R 13/642; H01R 11/22

[52] U.S. Cl. ..... 339/186 R; 339/219 F; 339/258 F; 339/262 F; 337/226

[58] Field of Search ..... 337/214, 215, 252, 225, 337/226; 339/150 F, 184 R, 186 R, 186 M, 219 F, 252 F, 253 F, 256 C, 258 F, 259 F, 262 F, 265 F

[56] References Cited

U.S. PATENT DOCUMENTS

| | | | |
|---|---|---|---|
| 2,942,228 | 6/1960 | Swick | 339/258 F X |
| 2,958,020 | 10/1960 | Eannarino | 339/258 F X |
| 3,890,032 | 6/1975 | Tillson | 339/258 F |
| 3,914,005 | 10/1975 | Tillson | 339/186 R |
| 4,178,063 | 12/1979 | Reynolds | 339/186 R X |
| 4,278,316 | 7/1981 | White | 337/252 X |

*Primary Examiner*—Gil Weidenfeld
*Assistant Examiner*—Steven C. Bishop
*Attorney, Agent, or Firm*—Andrus, Sceales, Starke & Sawall

[57] ABSTRACT

A fuse clip unit is constructed with an entrance unit having positive reject stops which prevent insertion of all except a selected fuse which provides branch circuit protection of 200,000 amps R.M.S. interrupting capacity. The selected fuse has a unique end nib which moves the stops to open the entrance unit and permit insertion of the fuse. The entrance unit may be integral with the fuse clip or formed as a separate cover. The fuse clip unit is secured within an insulating and mounting housing having clip chambers. A safety cover is secured to the housing overlying the chambers and includes a side insertion opening for each chamber which prevents access to the reject stops and thereby prevents manual moving of the stops to circumvent the reject stops.

12 Claims, 8 Drawing Figures

FUSE CLIP UNIT

BACKGROUND OF THE PRESENT INVENTION

This invention relates to a cartridge fuse clip and particularly to a fuse clip adapted to receive only a special constructed fuse, such as a high fault interrupting cartridge fuse.

Power systems use fuses to open the system in the event of abnormal current flow. A cartridge fuse which is widely used is a cylindrical tube having tubular end contacts. The fuse is inserted into a fuse box having spaced U-shaped fuse clips adapted to resiliently grip the end contacts. A highly satisfactory fuse clip is shown in U.S. Pat. No. 3,815,071 which issued June 4, 1974. Similar shaped fuses of substantially the same length and contact diameter have different current ratings. This group of similar fuses include a special high current limiting fuse which is rated at two hundred thousand amperes R.M.S. If a lower rating fuse is inserted in place of the special fuse, a dangerous safety condition is created and one which violates various recognized industrial standards. Special fuse clips have been suggested which accept only the special fuse. However, the inventors do not know of a relatively inexpensive reject fuse clip which is convenient to use while producing a positive rejection of all but the one fuse.

The present invention provides a clip with positive reject stops to give the fuse clip the ability to accept only a specific fuse and reject all others. Prior fuse clips did not have this type of construction.

SUMMARY OF THE PRESENT INVENTION

The present invention includes a U-shaped clip unit having an entrance or insertion opening which includes stops which prevent insertion of a fuse and an outwardly located actuating means for moving the stops so as to allow the fuse to be inserted. The special fuse includes a projection operable to engage the actuating means and appropriately move the stops.

More particularly, in one embodiment of this invention, the U-shaped clip is constructed with the entrance or insertion opening defined by opposed spaced shoulders aligned with the fuse contact. Integral with the end edge of the shoulder, is a pair of up-standing curved release fingers or ears. As the proper fuse is inserted, an end projection engages and spreads the ears, thereby spreading the shoulders sufficiently to receive the end contact or sufficiently so that the end contact is operable to further spread the shoulders and open the clip to receive the fuse.

The shoulders and tabs may be made integral with the sides of the U-shaped contact clip. In an alternate and particularly effective construction, a U-shaped clip is located within a separate encircling stop cover unit having a pair of flat stop walls overlying the insertion gap of the clip. The stop walls include upstanding flared actuating ears or fingers. The fuse including the end projection nib moves the stop walls to a critical gap. The fuse contact engaging the shoulders at the critical gap is operable to further deflect the shoulders and allow insertion of the fuse into the fuse clip.

Either clip may be readily incorporated into a special fuse housing having sidewise insertion passageway means to prevent circumventing of the protective feature. The top cover of the housing overlies the release tabs, and prevents separate engagement therewith for opening of the shoulders to the critical gap for insertion of an improper fuse.

The invention thus provides a fuse clip construction in which a fuse clip, normally assembled in spaced relation to another is provided with stops below the release ears of the clip at the entrance to the clip. The release ears are moveable by a special projection on a unique fuse, such that the fuse clip of the invention will only accept the special fuse type, such as the high interrupting capacity fuse which will operate the stop means, and thereby reject other fuses.

DESCRIPTION OF THE DRAWING FIGURES

The drawings furnished herewith illustrate a preferred construction of the present invention in which the above advantages and features are clearly disclosed as well as others which will be readily understood from the following description.

DESCRIPTION OF THE ILLUSTRATED EMBODIMENT

Figure 1:
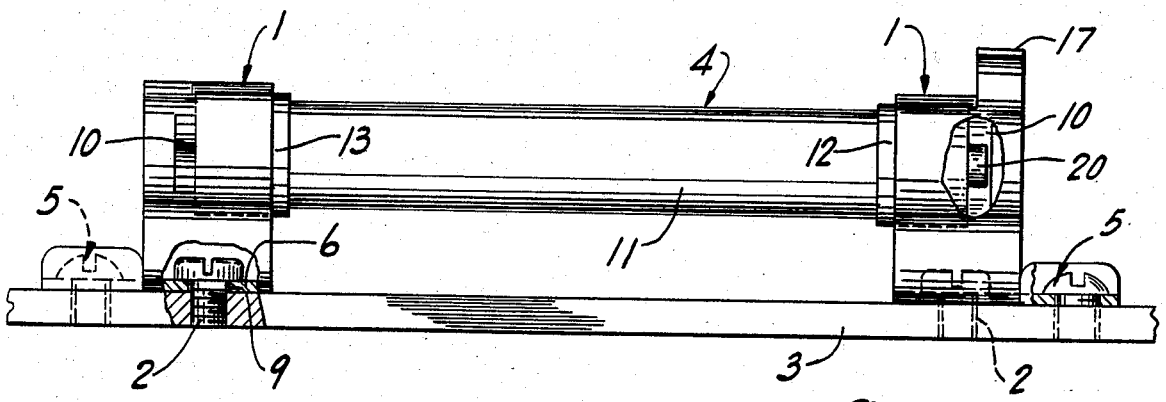
FIG. 1 is a front elevational view illustrating a pair of spaced fuse clips with a fuse held in place by the clips.

Referring to the drawings there is shown in FIG. 1 a pair of spaced fuse clip units 1 which are secured by screws 2 to a support member 3. Clamped between the fuse clip units 1 is a fuse 4. A lead connector 5 is provided at the outer end of each fuse clip unit 1 for connecting the clip units 1 and fuse 4 into an electrical circuit.

In the first embodiment, fuse clip units 1 are similarly shaped integral units formed from a single sheet of copper metal and each consists of a generally flat base 6, from each side of which upwardly projects the spaced resilient arms 7.

Arms 7 each curve upwardly from base 6 on a generally large radius to define spring arm connection **7*a* and then curves inwardly followed by a contact engaging curved portion 8 to define a fuse contact opening therebetween. An aperature 9 is provided in the base 6 to receive an attachment screw 2 for interconnecting of the clip units 1 to the support member 3. In addition, segments 10 are struck out of rear portion of the resilient arms 7 of the clip units 1. The segments 10 are bent inwardly immediately axially outwardly of the contact engaging portion 8. The struck-out segments 10 9 define endwise stops and locating members which prevent endwise movement of the fuse 4 when clamped within the spaced fuse clip units 1, as shown in FIG. 1**.

The cartridge fuse 4 is shown as a well known construction including an elongated, cylindrical housing 11 within which a fuse element, not shown, is housed.

Similar cylindrical end cap contacts 12 and 13 are secured to the opposite ends of the housing 11 and of course interconnect to the internal fuse mechanism. Each contact 12–13 is of the same diameter. The curvature of the clip side arms 7 have the same radius and configuration as the contacts and define a contact holding portion. The clip unit 1 thus resiliently grasps the fuse contacts 12 or 13 inserted into the clip.

Each resilient clip unit 1 is thus generally similar to that disclosed in U.S. Pat. No. 3,815,071. However, the clip in that patent includes upper flange end extensions of each resilient arm 7 specially formed as flared fingers or ears which extend angularly outwardly to define the fuse entry end of the clip 1. The flared construction facilitates the convenient and sidewise deflection of the resilient clip arms, such that the fuse can be readily pushed inwardly into the fuse clip with the end face of the fuse aligned with the struck-out segments 10. In the present invention, the clip unit 1 is specially formed to eliminate such deflection ears and instead to insert and provide means to prevent such standard deflection. In the illustrated embodiment, the outer portions of the clip arms 7 extend inward with the continuing curvature 8 corresponding to the fuse contacts and terminate in outwardly extending insertion stop shoulders or tabs 15.

The shoulders or stop tabs 15 are spaced axially inwardly of the endwise stop segments 10 and thus are aligned with an end contact 12 or 13 of the cartridge fuse 4.

In the present invention, the entrance gap 16 defined by the spaced stop tabs 15 is such that the contact 12 of the fuse 4 cannot be forced directly into the contact clip, such as in the conventional practice. In particular, the gap 16 is such that when the fuse contact 12 is positioned onto the stop tabs 15 and an insertion force applied to move it into the contact clip, there is essentially no lateral reflection force on the tabs 15 and the arms will not deflect. Excessive force to insert the clip results in deformation in the clip rather than the appropriate outward deflection, and a conventional cartridge fuse cannot be introduced without positively opening of the contact arms by some other means.

Figure 2:
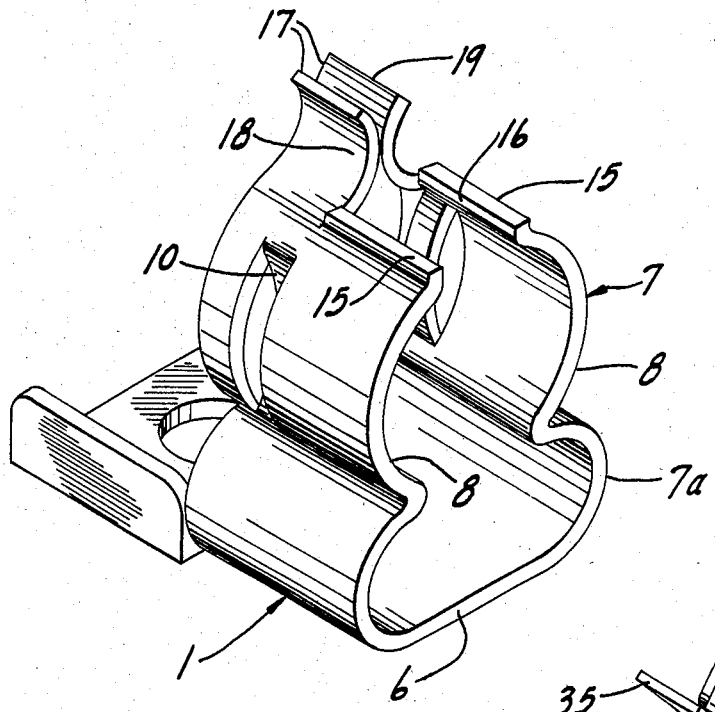
FIG. 2 is a perspective view of a clip of the first embodiment of the invention.
Figure 3:
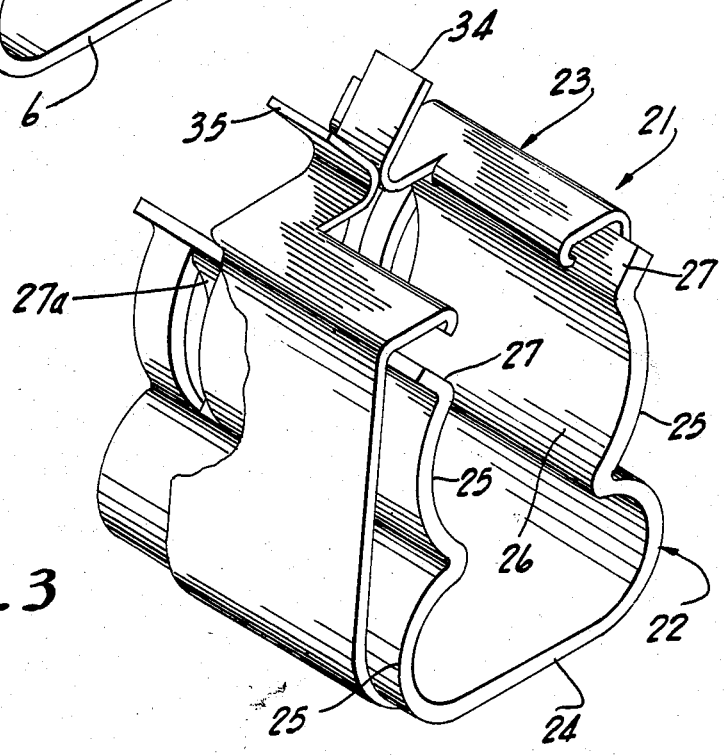
FIG. 3 is a perspective view of a second embodiment of the invention.

In the illustrated embodiment of the invention shown in FIGS. 1 and 2, a pair of release ears 17 are provided on the endwise stop portion of the fuse clip 1. The illustrated release ears 17 are flared ears angularly extending from the outer ends of the endwise stop segment portions of the side arms 7. Each ear 17 is formed as an upward extension of the clip side arm and curves outwardly and inwardly to an inner bend 18 from which the ears flare outwardly at an angle to define a camming entrance surface 19. The ears 17 are similarly located substantially above the stop shoulders or tabs 15 with the connecting curved bend 18 shown in substantial abutting engagement in the unstressed state of the fuse clip 1. The flared entrance 19 is, in particular, constructed and arranged to cooperate with the end nib or projection 20 on an acceptable fuse 4, such as particularly shown in FIGS. 1 and 3. More particularly, the illustrated fuse structure is typical of a high interrupting rated fuse, such as the fuse having an A.C. current limiting and interrupting rating of a 200,000 amperes RMS which is manufactured and sold by Bussman Company under the trademark "KTK-R." The fuse, as illustrated, includes the small end projection or nib 20 on the one end of the fuse. The nib 20 has a substantially smaller diameter than the end contact 12 and projects outwardly therefrom. When the nibbed fuse 4 is introduced into the fuse clip 1, the nib 20 moves into engagement with the release ears 17, slightly prior to the engagement of the fuse contact 12 with the stop shoulders or tabs 15. The nib 20 acts on the angled or flared release ears to exert a sidewise opening force which is effective to deflect the arms 7 outwardly, thereby increasing the gap 16 between the stop tabs 15 of the contact arms 7. With the nib 20 in centered alignment with the opposed inner bends 18 of the release arms, the stop shoulders or tabs 15 are spaced to be engaged by an outermost portion which is that portion of the fuse contact located just inwardly of its outermost diameter. In this position, the lateral force exerted by the fuse contact 12 is greatly increased and is sufficient to fully deflect the spring arms 7 and permit introduction of the fuse. The embodiment of the present invention as shown in FIGS. 1–3, provides a fuse clip which prevents insertion of fuses other than the especially constructed nibbed fuses. This ensures that only a particular or special current rated fuse can be introduced into the system.

Figure 4:
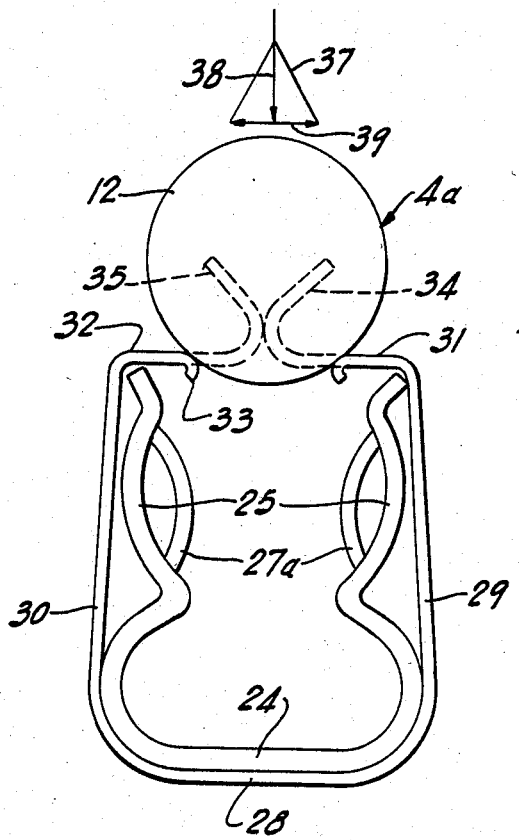
FIG. 4 is a front elevational view of the clip of FIG. 3 with a conventional fuse in place for insertion.
Figure 5:
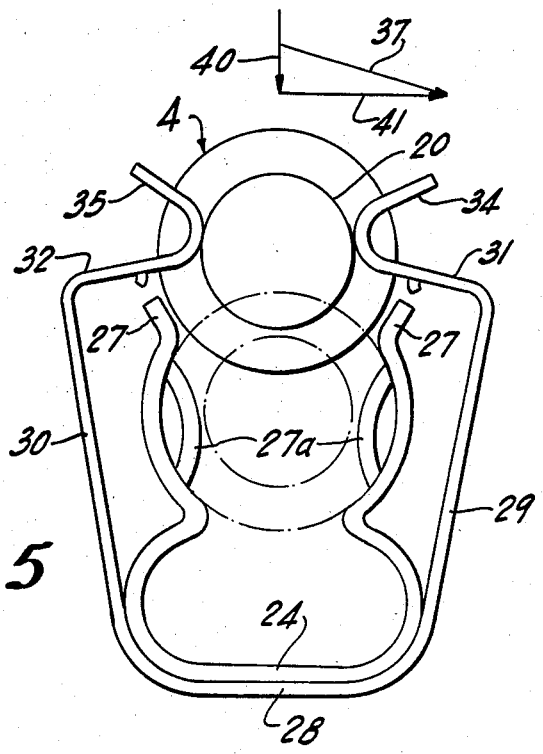
FIG. 5 is a view similar to FIG. 4 illustrating the insertion of the special fuse.

A second and preferred embodiment of the invention is illustrated in FIGS. 3–5. In this embodiment of the invention, a contact clip unit 21 is formed and constructed as a two-piece assembly including an inner contact clip 22 of a more or less conventional construction and an outer stop cover 23. The contact clip 22 is shown corresponding to that in the previously identified United States patent for simplicity of explanation. The clip 22 generally includes a base structure 24 and curved, resilient side arms 25. Each side arm 25, however, has a somewhat lesser curved than in the first embodiment to define a substantial entrance gap 26 and terminate at the upper end in the known flared entrance ears 27, such that insertion engagement of a fuse contact therewith permits convenient entrance into the fuse clip 22, as shown in FIG. 5 and hereinafter discussed. The clip 22 also includes the struck-out endwise stop segments **27*a*. This permits construction of the reject clip with a conventional standardized fuse clip 22**, which may be separately applied for use with other fuses.

In the present invention, however, the special reject cover 23 is secured overlying the fuse clip 22. The illustrated reject cover 23 is generally a single piece U-shaped cover having a lengthwise extent somewhat less than that of the fuse clip. The cover 23 also includes a base 28 underlying the fuse clip base 24 and firmly interconnected thereto in any suitable manner. Straight side arms 29 and 30 extend upwardly from the base 28 past the clip side arms 25. Laterally extending flat walls 31 and 32 are secured to the upper edges of the arms 29 and 30 respectively, and project inwardly in a common plane toward each other. The walls 31 and 32 terminate in spaced relation to each other and the inner opposed ends can be bent backwardly as at 33 to define smooth curved edge surfaces. A pair of release ears 34 and 35 are secured to the walls 31 and 32 and are located lengthwise outwardly of the contact arm portions and generally in alignment with the endwise stop segments **27*a* of the fuse clip 22**.

The release 34–35 ears are shown integrally formed with the top walls. Referring to release ear 34, the ear curves outwardly with an unstressed point of engagement located outwardly of the fuse clip 22, after which the ears flares outwardly at a relatively sharp angle to again define a U-shaped camming entrance opening for accommodating the nib 20 of a special fuse 4. In this embodiment of the invention, the release ears 34–35 are arranged and constructed such that when the fuse nib 20 moves into engagement therewith, it deflects the cover sidearms 29–30 to the extent necessary to allow the contact to engage the stop wall edges 33 for final deflection thereof. At that position, the contact 12 is also about to move into deflection alignment with the clip arms 25 and particularly the flared ears 27, as shown in FIG. 5.

As shown in FIGS. 4 and 5, the result of an applied insertion force on a fuse into the fuse clip unit, with and without the release nib, is shown. FIG. 4 illustrates fuse 4*a* without a nib located in the initial opening position. A downward force applied to the fuse 4*a* without the end nib establishes a force 37 acting from the center of the fuse at an angle to the two stop shoulders. The force diagram in FIG. 4 of the insertion force illustrates the distribution of the force. Thus, the force is created at a relatively sharp lead entrance angle, with an essentially large vertical force 38 and a relatively small lateral force 39. The force distribution is such that an exertion of a force sufficient to deflect the stop arms 29–30 laterally to release the stop walls 31–32 would result in an inward bending thereof, such as to prevent the actual entrance of the fuse into operative engagement within the fuse clip.

However, with the nib 20 located within the release ears 34–35, the insertion force 37 distribution resulting from the nib and the flared release ears produces a smaller vertical force 40 and a much greater lateral force 41, as shown in phantom in FIG. 5. As a result, the conjoint operation of the nib 20 and release ears 34–35 deflect the stop walls 31–32 laterally, as shown in FIG. 5, thereby permitting the fuse contact 12 to move between the walls and into engagement with the release ears 27 of the clip 22. The fuse contact acts on the standard operative clip ears 27 with deflection of the clip arms 25 and insertion of fuse 4 into the fuse clip 22.

The two-piece construction provides standardization of the fuse clip structure as such while permitting the selective incorporation of the reject mechanism in a relatively simple and inexpensive system.

Figure 6:
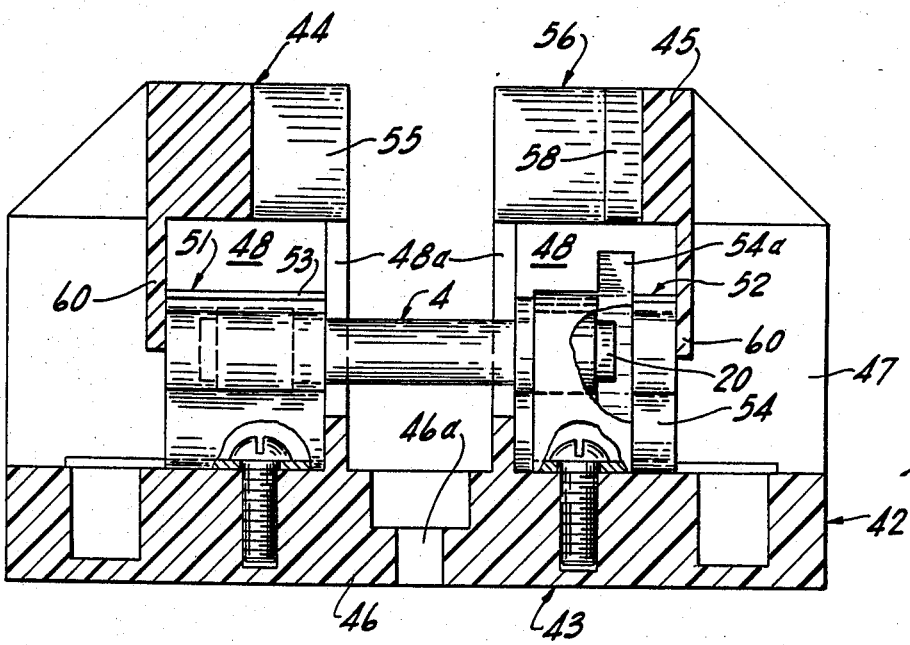
FIG. 6 is a vertical section through a fuse block assembly for the fuse clip of FIGS. 3–5.
Figure 7:
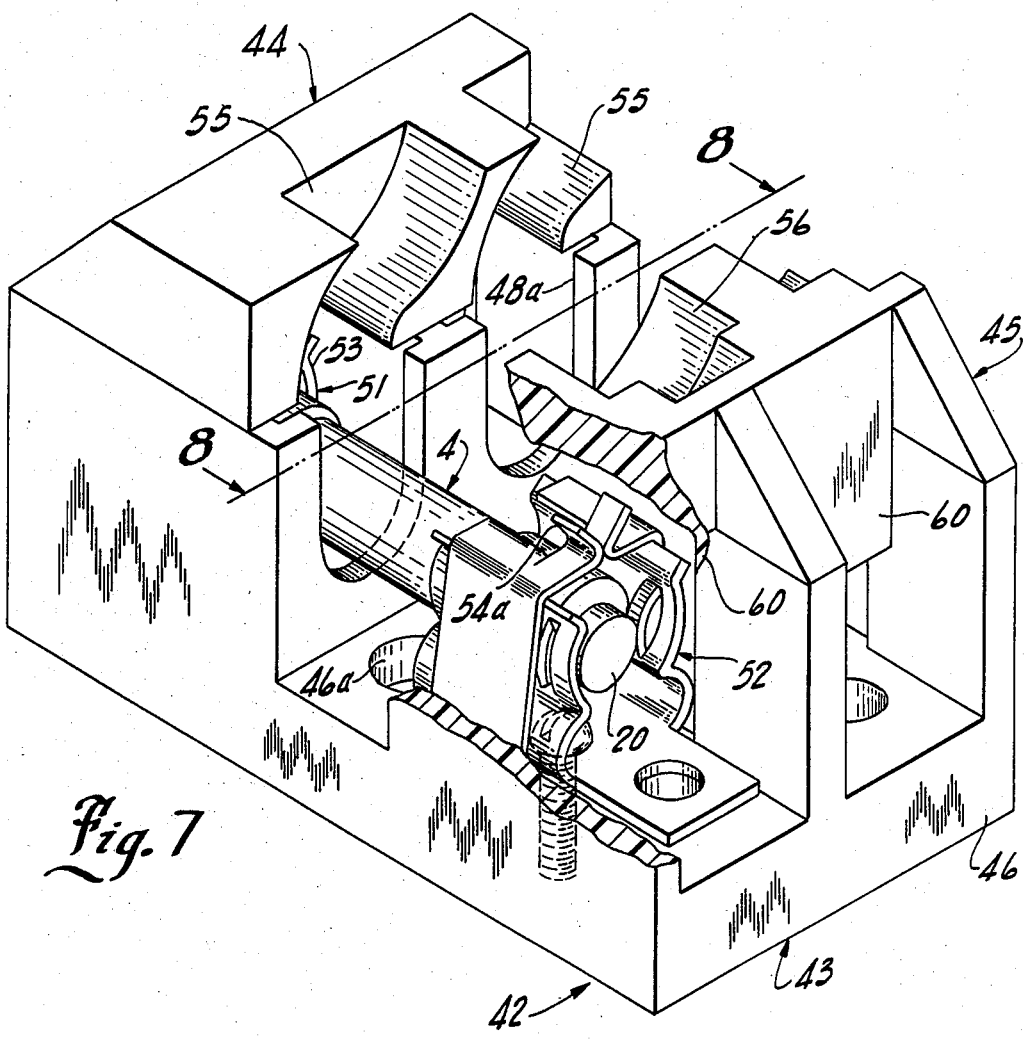
FIG. 7 is a pictorial view of the fuse block assembly.
Figure 8:
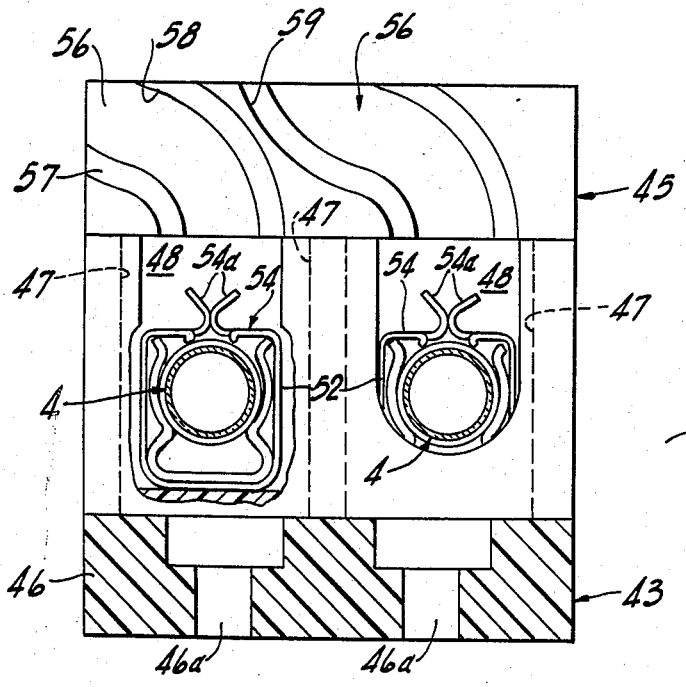
FIG. 8 is a transverse section taken generally on line 8—8 of FIG. 7.

The direct application of the fuse clip to a panel structure of course would permit circumvention of the reject mechanism by the separate introduction of a tool into the release ears or tabs 17 of clip 1 or 34–35 of the two-piece clip unit 21. To prevent such undesired circumvention, the inventors have constructed a special mounting for the reject fuse clip, an embodiment of which is shown in FIGS. 6–8. The illustration is for a two-fuse panel mounting block 42. As shown in the FIGS. 6–8, the mounting block 42 includes a base section 43 of a conventional construction in combination with outer covers 44–45 which are affixed to opposite ends of the base section and limit the introduction of a fuse 4 into the fuse clip structure.

The standard base section 43 is an integrally formed plastic unit and includes a flat mounting base 46 which is adapted to be secured to a suitable power panel, not shown, by a plurality of mounting bolts through centrally located openings 46*a*. Spaced parallel walls 47 are secured to the opposite ends of the mounting base and define side-by-side fuse clip chambers 48 at each end. The chambers 48 also include partial front walls 48*a* secured to the parallel walls. The fuse clip chambers 48 at the opposite ends are aligned with each other and have fuse clip units 51 and 52 mounted as by the appropriate mounting screws.

The spaced chambers define a center opening or space through which the fuse 4 is adapted to be introduced into the fuse block.

The base structure 43 is shown as and may be a more or less conventional structure, and no further description thereof is given herein other than as the sections are constructed and arranged to receive the fuse reject clip units 51–52, as shown in the drawings. Clip unit 51 is a standard U-shaped fuse clip unit having the integrated release ears 53. The aligned clip unit 52 is a reject fuse clip unit and is shown as a two-piece unit with the outer reject cover 54 having the release ears 54*a* corresponding to the structure of FIGS. 3–5. The housing covers 44–45 are affixed to the opposite clip-in sections or chambers of the base block 43. The covers 44–45 are affixedly attached to the mounting block 43 to insure continued functioning of the reject function. The two-piece fixed construction of the base block and separate cover means permits, once again, the use of a standarized mounting base with attachment of a special cover structure for the special application requiring the reject fuse.

Each cover 44–45 is a similar block-like member including a pair of special insert openings or passageways 55–56 to each of the vertical fuse clip chambers 48, as shown most clearly in FIG. 8.

The fuse cover 45 enclosing the reject fuse clip includes a stepped passageway 56 for each fuse. The passageway 56 includes an outer lateral entrance 57 which terminates in the outer corner of the block-like cover. The passageway 57 curves not only laterally but inwardly into alignment with the clip chamber 48 and then curves rapidly into the top thereof. Thus, the cover provides a solid cover portion overlying the top entrance to chamber 48, and prevent insertion of a tool inwardly into engagement with the release ears. The passageway 56 is a stepped passageway with a relatively large outer width corresponding to the width of the contact and a stepped reduced portion or recess 58 corresponding to the width of the fuse nib 20.

The second passageway 56 has an entrance opening 59 in the outermost wall of the block cover 45 and is of a stepped or recessed construction to receive the nib 20 of the special fuse. The second passageway 56 again curves inwardly and downwardly into alignment with the fuse clip chamber 48 and then extends into the chamber.

The covers 44 and 45 also include depending outer walls 60 which extend into each aligned chamber 48 and abut the outer ends of the clips 51 and 52. The walls 60 of cover 45 in particular prevent entrance from the end of the chamber into the release ears 54*a*.

The opposite cover 44 is secured to the opposite end of the block 43 and is formed with two similar passageways 55, without the nib extension in either passageway.

This restricts the introduction of the cartridge fuse 4 into the fuse mounting block assembly 42 in a single orientation and in particular permits the construction of the fuse assembly with the reject fuse clip 52 only to one side of the mounting block 43.

Thus, in operation, the operator would insert the fuses 11 essentially in the same manner as in the prior art structure. In this instance, however, the fuse 4 must be inserted through the special passageways 55–56 moving laterally and then inwardly into alignment with the covered fuse clip chambers 48 and only then moved inwardly in accordance with conventional practice.

When moved into alignment with the reject fuse clip unit 52, however, only the fuse 4 with the special projection or nib 20 can be inserted into operative relation into the aligned fuse clip unit 52. This special mounting block assembly essentially fully restricts the insertion of fuses into the fuse clip only in a proper, authorized manner. Thus, the block covers 44 and 45 which overlie the chambers 48 essentially prevent insertion of a tool, such as a screwdriver into the release ears of clip units 52 and thereby prevent circumvention of the reject clip function.

The fuse clip of both embodiments of the invention has a positive reject construction which prevents the use of useless and unsafe fuses. It also is of one piece and has a low profile. It also provides a large current contact area with the fuse.

The second embodiment of the invention has a cover of a material of spring steel for strength and the construction acts as a reinforcing spring.

The big problem is that there are fuses very close in length and identical in diameter to the high interrupting capacity fuse, and both embodiments of the present invention provide positive reject features or stops which insure that the clips will only accept such a fuse with high interrupting capacity and therefore eliminates the problem that a dangerous mistake might be made when a fuse not providing this protection is inserted in the fuse clips.

Various modes of carrying out the invention are contemplated as being within the scope of the following claims, particularly pointing out and distinctly claiming the subject matter which is regarded as the invention.

We claim:

1. A multiple component metal fuse clip unit for a cartridge fuse and rejecting all fuse contacts except a tubular fuse contact with an end projection nib of a diameter less than the diameter of said contact, a generally U-shaped fuse clip having spaced resilient contact arms having a curved upper portion for receiving and gripping a tubular fuse contact with such arms having an upper inwardly projecting portion defining a fuse entrance end and having endwise stop portions defining endwise stops to locate the fuse contact endwise in the clip, a reject cover means including resilient arms extending along the opposite sides of the fuse clip arms and having inwardly extended reject walls located over the entrance end of the fuse clip, said reject walls being aligned with the contact portion of the clip arms and a release portion coupled to said walls located longitudinally outwardly of the fuse clip arms, said reject walls projecting over the contact clip toward each other and being spaced therefrom to define an insertion gap substantially less than the diameter of a fuse contact adapted to be inserted into the fuse clip, said release portion including outwardly flared portions for receiving said reduced projecting nib on the end of a fuse, said flared portions and said reject portions being arranged and constructed whereby said nib engages said flared portion and deflect the reject arms laterally and thereby moving said reject walls outwardly whereby the fuse contact is allowed to move inwardly between the contact arms and into operative engagement with the fuse clip.

2. The apparatus of claim 1 wherein the fuse clip includes insertion ears flaring outwardly from the resilient side arms of the fuse clip for effective insertion of the fuse contact into the clip, said insertion ears being spaced substantially in accordance with the diameter of the fuse contact such that minimum overtravel of the ears at the fuse entry of the clip is created upon insertion of the fuse into the clip and thereby establishing a generally low non-holding movement in the fuse clip during insertion.

3. The multiple component metal fuse clip unit of claim 1 wherein said U-shaped fuse clip includes a generally flat base integrally formed with said spaced resilient contact arms extending outwardly from the base, each said contact arm having an upper curved projecting portion defining a flared fuse entrance end adapted to be engaged by the fuse contact to deflect the contact arms for insertion, of the fuse contact.

4. The fuse clip unit of claim 3 wherein said reject cover means includes a flat base abutting the base of said U-shaped fuse clip and said resilient arms extending outwardly from the cover base in generally spaced parallel relation past each of the fuse clip contact arms and terminating in the upper end in inwardly extended coplanar flat walls defining said reject walls projecting toward each other over the entrance end of the fuse clip, each of said reject walls being similarly constructed and having said reject portion aligned with the contact portion of the clip contact arms and said release portion integrally formed with said reject portion and aligned with the endwise stop portions of the fuse clip.

5. The apparatus of claim 4 wherein said release portion including a flat wall portion coplanar with said reject walls and including outwardly curved walls defining a pair of closely abutted spaced portions and said curved walls being integrally formed with the ends of the reject walls.

6. The fuse clip unit of claim 1 wherein said fuse clip has a substantially flat base and said contact arms extending outwardly from the base, said reject cover is a single piece member including a generally flat base abutting the flat base of said fuse clip and said resilient arms being substantially flat member and extending outwardly from the cover base in generally spaced parallel relation past each of the fuse clip arms and terminating in the upper end in inwardly extended flat walls projecting toward each other over the entrance end of the fuse clip to define said reject walls, each of said flat walls being similarly constructed and including a reject portion overlying the contact portion of the clip arms and said release portion being integrally formed with the resilient arms and the endwise stop portions of the fuse clip, said reject walls being substantially flat and planar members projecting over the contact clip toward the corresponding opposed stop wall and being spaced therefrom to define an insertion gap substantially less than the diameter of a fuse clip contact adapted to be inserted into the fuse clip, said release portion including flat reject walls overlying said insertion gap and said endwise stop portions, said flat reject walls being coplanar and including outwardly curved release walls defining a pair of closely abutted spaced portions and outwardly flared portions for receiving said reduced projecting nib on the end of a fuse.

7. The apparatus of claim 6 wherein said fuse clip includes ears flaring outwardly from the resilient side arms of the fuse clip for effective ready insertion of the fuse contact into the clip with minimum overtravel of the ears and clip arms upon insertion of the fuse into the clip and thereby establishing a generally low non-holding movement in the fuse clip during insertion.

8. In a releasable cartridge fuse block assembly adapted to receive a cartridge fuse having a special exterior structure on at least one end thereof, a fuse clip mounting base having a pair of spaced and aligned fuse clip contact chambers having a fuse entrance, a fuse clip secured in each chamber for releasably receiving a cartridge fuse, at least one of said fuse clips including a fuse reject means requiring conjoint interaction with the special exterior structure of a selected fuse for introduction of the cartridge fuse whereby said fuse clip rejects all fuses except a fuse with said special structure, a cover secured to said mounting base and including a wall spanning the entrance to the fuse clip chamber, said cover including an offset insert passageway extending laterally and into alignment with the fuse clip entrance whereby said fuse can only be introduced by a combined lateral and then inward movement of the fuse cartridge through the cover and into the fuse clip chamber whereby access to such fuse clip is essentially restricted so as to prevent circumvention of the conjoint interaction of the fuse clip and the selected fuse.

9. The releasable cartridge fuse block assembly of claim 8 wherein said fuse clip includes resilient arms adapted to engage a cartridge fuse contact, said fuse reject means includes stop shoulders on the fuse clip arms and having a release ear spaced from said shoulders, said ear being located in the path of the projection whereby said fuse clip rejects all fuses except a fuse with said projection, said insert passageway having an off-set portion to receive said projection.

10. The releasable cartridge fuse block assembly of claim 9 for receiving a cartridge fuse wherein said special exterior structure is an end projection nib of a diameter substantially less than that of the fuse, contact.

11. The fuse block assembly of claim 10 wherein said fuse clip secured in each chamber includes resilient arms shaped to grasp the cylindrical end of a cartridge fuse, said selected fuse having a projecting end nib, said fuse reject means includes spaced shoulders defining a gap substantially less than the diameter of the fuse contact so as to prevent forcing of the contact between said arms, means coupled to said shoulders for conjoint interaction with the nib of the fuse for introduction of the cartridge fuse whereby said fuse clip rejects all fuses except a fuse with said special nib.

12. The fuse block assembly of claim 8 wherein said insert passageway is a continuously curved member extending laterally into alignment with the fuse clip entrance.

* * * * *

UNITED STATES PATENT AND TRADEMARK OFFICE

CERTIFICATE OF CORRECTION

PATENT NO. : 4,547,036

DATED : October 15, 1985

INVENTOR(S) : Josef Keglewitsch et al

It is certified that error appears in the above-identified patent and that said Letters Patent is hereby corrected as shown below:

Col. 2, line 62, cancel "109" and substitute therefore ---10---; Col. 4, line 65, cancel "flares" and substitute therefore ---flare---; Col. 10, line 8, after "fuse" delete "," (comma)

Signed and Sealed this

*Sixth* Day of *May 1986*

[SEAL]

*Attest:*

DONALD J. QUIGG

*Attesting Officer*

*Commissioner of Patents and Trademarks*